United States Patent [19]

Becka

[11] Patent Number: 4,470,165

[45] Date of Patent: Sep. 11, 1984

[54] TOE LASTING MACHINE WITH ADJUSTABLE HEEL CLAMP PAD

[75] Inventor: Michael M. Becka, Nashua, N.H.

[73] Assignee: International Shoe Machine Corporation, Nashua, N.H.

[21] Appl. No.: 403,184

[22] Filed: Jul. 29, 1982

[51] Int. Cl.[3] ..... A43D 21/16; A43D 21/00

[52] U.S. Cl. ..... 12/12; 12/14.4; 12/145

[58] Field of Search ..... 12/12, 14.4, 145, 14.3

[56] References Cited

U.S. PATENT DOCUMENTS

Re. 26,860 4/1970 Becka ..... 12/145

*Primary Examiner*—Werner H. Schroeder

*Assistant Examiner*—Steven N. Meyers

[57] ABSTRACT

A toe lasting machine (10) for operating on a shoe assembly (66) formed of a last (68) having an upper (70) draped thereon and an insole (72) secured to its bottom by wiping the margin (74) of the toe portion of the upper against the insole while the heel portion of the shoe assembly is engaged by a heel clamp pad (29) that is moved in a rearward direction against the heel portion of the shoe assembly. The heel clamp pad (29) is so connected to a slide (42) that is yieldably urged upwardly as to have unitary heightwise movement with the slide (42). The slide (42) and the heel clamp pad (29) are mounted for forward-rearward swinging adjustment about a prone axis that is transverse to the rearward direction.

4 Claims, 6 Drawing Figures

TOE LASTING MACHINE WITH ADJUSTABLE HEEL CLAMP PAD

BACKGROUND OF THE INVENTION

U.S. Pat. No. Re. 26,860 shows a toe lasting machine operable on a shoe assembly formed of a last having an upper draped thereon and an insole secured to its bottom to wipe the toe portion of the margin of the upper against the corresponding portion of the insole. This machine comprises: wiping means mounted for forward and inward movement in a wiping stroke from a retracted position in a wiping plane to wipe the toe portion of the upper margin against the insole; an insole rest, located forwardly of the wiping means in its retracted position, mounted for heightwise movement, so supporting the shoe assembly with the toe portion of the shoe assembly facing rearwardly that the toe portion of the insole bottom is inclined upwardly in a heelward and forward direction relative to the wiping plane after the toe portion of the upper has been stretched about the vamp of the last pursuant to relative upward movement of the insole rest with respect to pincers gripping the toe portion of the upper margin; a heel clamp pad, mounted for movement in forward-rearward directions, located forwardly of the insole rest and engageable, pursuant to its rearward movement, with the heel end of the shoe assembly; a slide mounted for heightwise movement; spring means yieldably urging the slide upwardly; connecting means connecting the heel clamp pad to the slide for heightwise movement therewith; means for lowering the insole rest out of the path of movement of the wiping means during the wiping stroke to prevent engagement of the insole rest by the wiping means during the wiping stroke; and a toe hold-down, located above the insole rest, mounted for downward movement against the vamp of the shoe assembly to press against the vamp of the shoe assembly to clamp the shoe assembly between the toe hold-down and the insole rest prior to the lowering of the insole rest and to thereafter clamp the shoe assembly between the toe holddown and the wiping means, the pressing of the toe hold-down against the rock downwardly until the insole is fully supported by the insole or the wiping means. During the downward rocking of the heel end of the shoe assembly, the heel clamp pad moves downwardly against the force of the spring means to enable the heel clamp pad to continue to engage the heel end of the shoe assembly without shifting with respect to the heel end of the shoe assembly.

SUMMARY OF THE INVENTION

With the prior art machine as exemplified in U.S. Pat. No. Re. 26,860 and as set forth in the preceding paragraph, problems of the heel clamp pad binding against the heel portion of the shoe assembly during the downward rocking of the heel portion of the shoe assembly developed. In addition, during the downward rocking movement, there was a tendency of the heel clamp pad to mar, scuff or wrinkle the heel portion of the upper and to shift the heel portion of the upper on the last.

In accordance with this invention, these problems are alleviated by mounting the slide, together with the heel clamp pad, for forward-rearward swinging adjustment about an axis transverse to the forward-rearward directions so that the heel clamp pad can be adjusted to be substantially in the plane parallel to the tangent of the heel portion of the last.

DESCRIPTION OF THE PREFERRED EMBODIMENT

Figure 1:
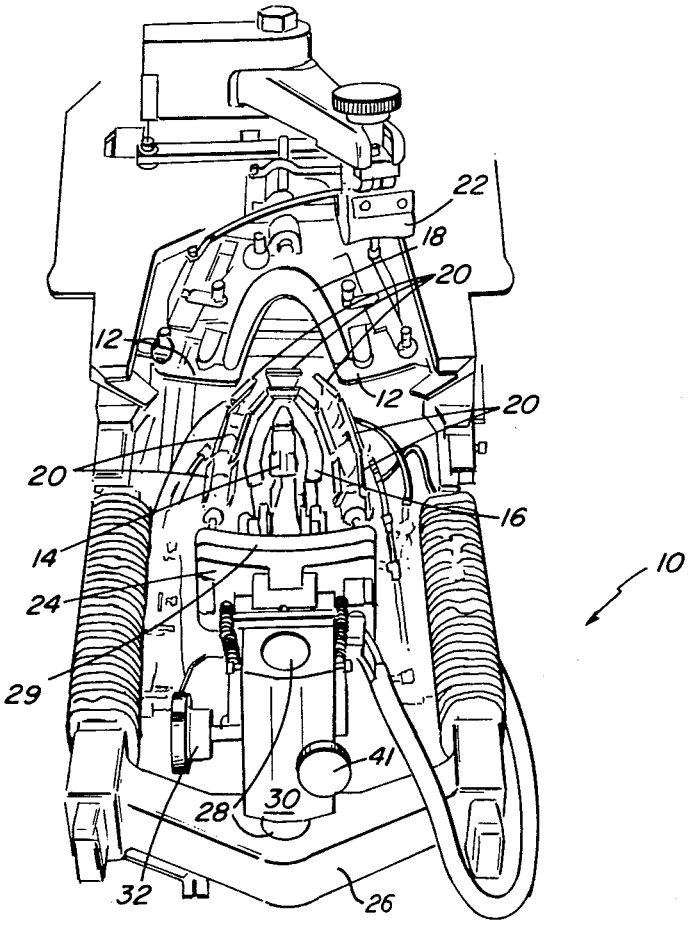
FIG. 1 is a front elevation view of a portion of the machine of this invention.
Figure 2:
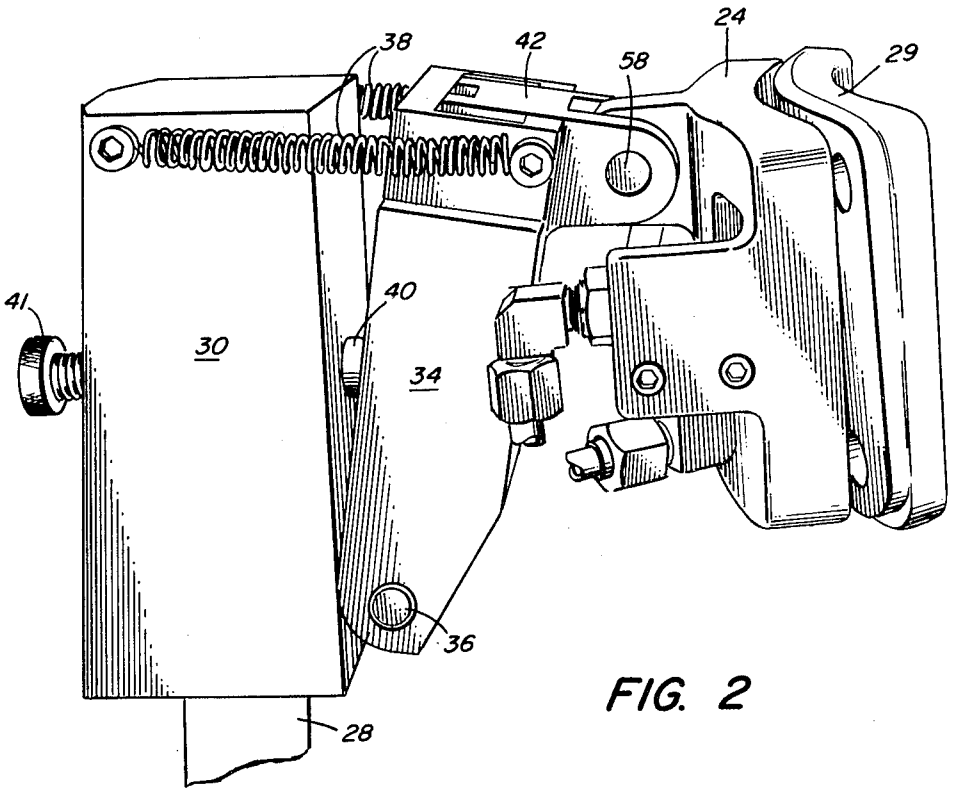
FIGS. 2–5 are isometric views of a heel clamp mounting the heel clamp pad, the slide and the mechanism for effecting the swinging adjustment of the slide.
Figure 3:
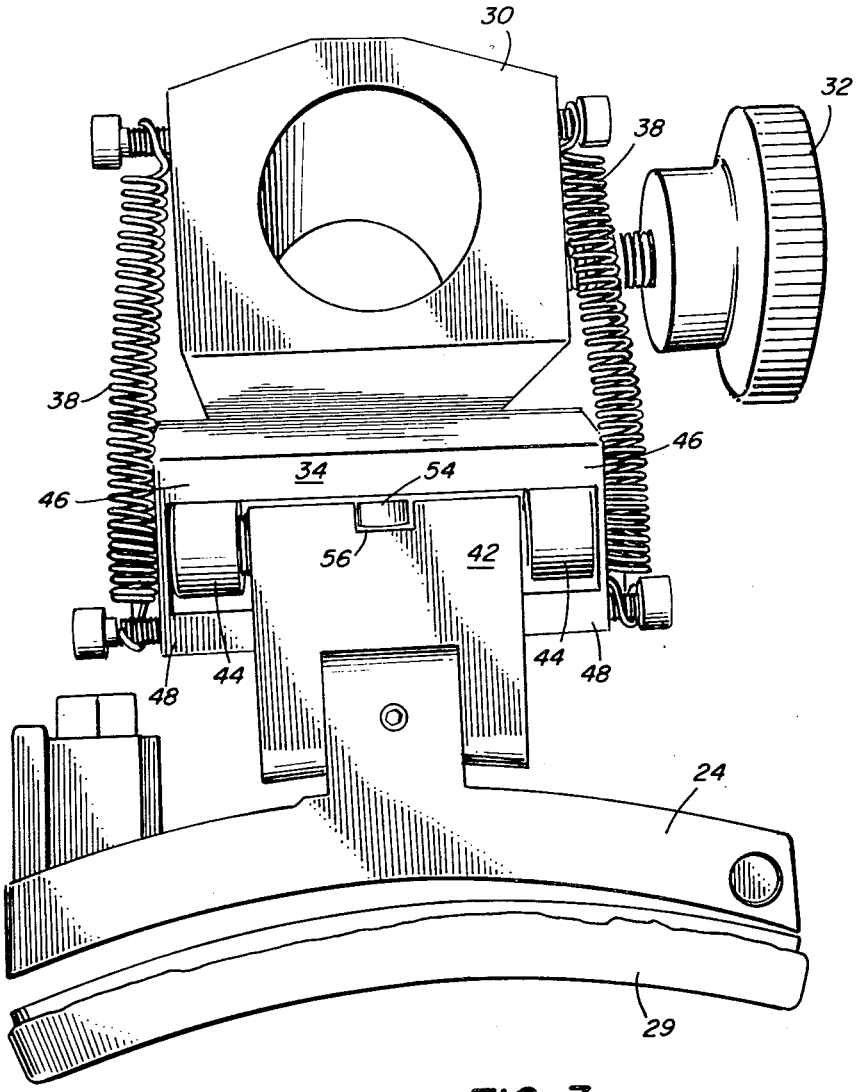
Figure 4:
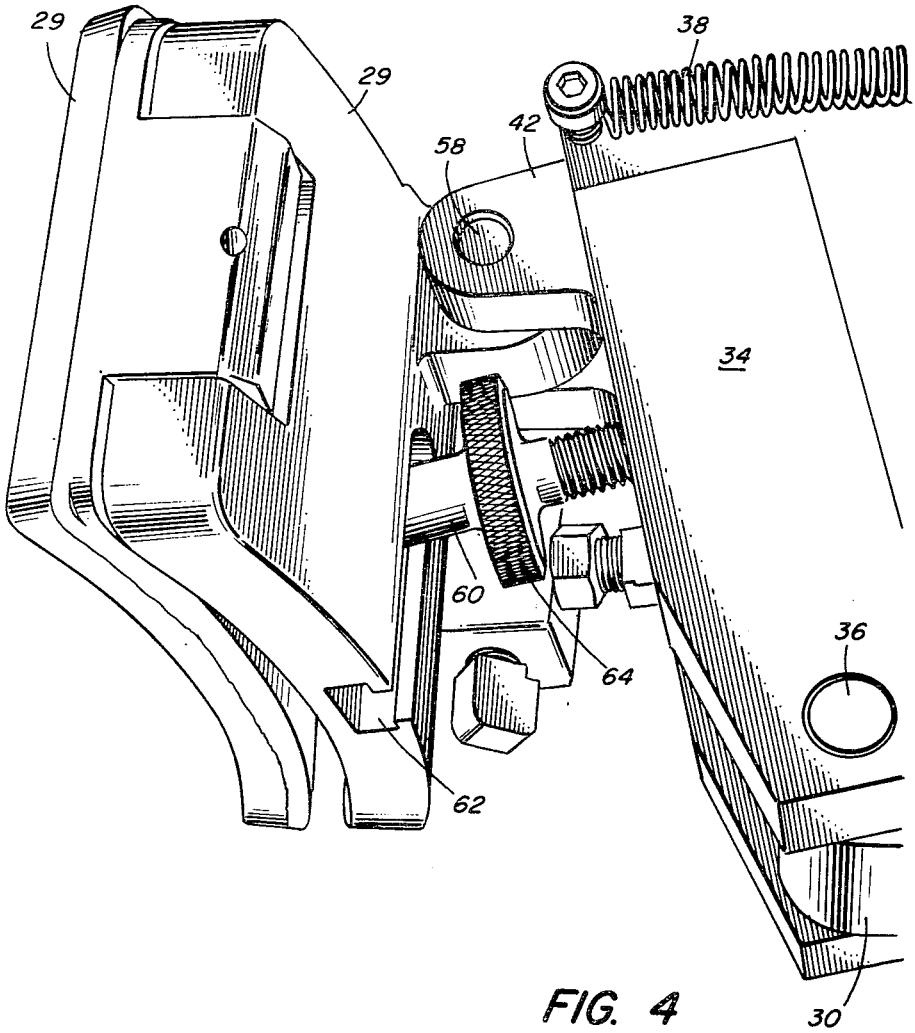
Figure 5:
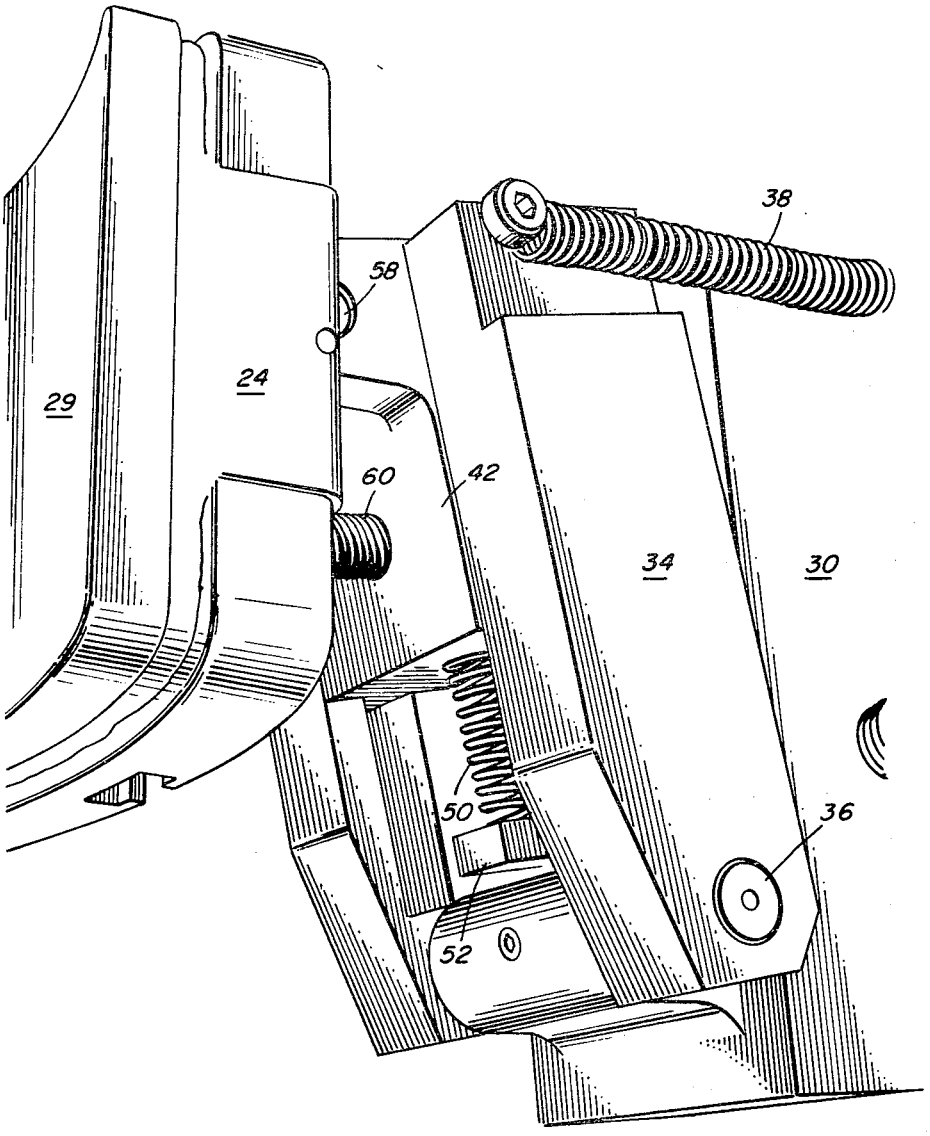

FIG. 1 shows the toe lasting machine 10 that, except for the heel clamp, is of conventional construction in accordance, for example, with the disclosures of U.S. Pat. Nos. Re. 26,860 and Re. 29,069. The operator is intended to stand in front of the machine 10 as seen in FIG. 1 and a direction extending towards the operator will be referred to as forward while a direction extending away from the operator will be referred to as rearward.

The machine 10 is inclined for ease of presentation of shoe assemblies thereto and convenience of operation. The machine includes substantially flat wipers 12 that are therefore inclined from the horizontal. However, for ease of explanation, a direction lying substantially in the plane of the wipers 12 will be referred to as horizontal and a direction at right angles to the plane of the wipers 12 will be referred to as vertical.

The machine 10, as is conventional, has an insole rest 14 mounted for heightwise movement; an adhesive applicator 16 located outwardly of the insole rest 14 mounted for heightwise movement; the wipers 12 located rearwardly of the insole rest mounted for planar forward and inward movement; a U-shaped yoke 18 located above the level of the wipers 12 rearwardly of the insole rest having a pair of forwardly divergent legs; a plurality of pincers 20 extending rearwardly of and laterally about the insole rest 14 and the adhesive extruder 16 having jaws movable between open and closed positions; a toe hold-down 22 movable from the lateral out-of-the-way position shown in FIG. 1 to a working position above the insole rest 14 and movable heightwise towards and away from the insole rest 14; and a heel clamp 24, mounted to a cross-bar 26 by a post 28, located forwardly of the insole rest 14 for movement towards and away from the insole rest 14. A heel pad 29 is mounted to the back of the heel clamp 24. This invention is concerned with the construction and mounting of the heel clamp 24 and the heel pad 29.

Referring to FIGS. 2–5, a block 30 is movably mounted to the post 28 to be set in a desired heightwise position on the post 28 by manipulation, in a manner not shown, of a knob 32 threaded into the block 30. The bottom of an arm 34 is pivoted to the block 30 on a pivot pin 36 for swinging forward-rearward movement towards and away from the insole rest 14 about the axis of the pin 36. Springs 38, extending between the block 30 and the arm 34, yieldably urge the arm 34 forwardly about the axis of the pin 36 to an adjusted position determined by the engagement of the arm 34 with a bolt 40 that is threaded into the block 30 and that is manipulable by a knob 41.

A slide 42 is mounted in the arm 34 for heightwise movement by rolls 44 on the slide 42 being movable between flanges 46 and 48 of the arm 34. A spring 50 interposed between the bottom of the slide 42 and a lug 52 on the arm 34 yieldably urges the slide 42 upwardly to a position wherein a pin 54 on the arm 34 riding in a slot 56 in the slide 42 engages the bottom of the slot 56.

The heel clamp 24 is pivoted to the top of the slide 42 by a pin 58 for forward-rearward swinging movement towards and away from the insole rest 14. A stud 60 is interposed between the heel clamp 24 and the slide 42 with the front of the stud 60 being threaded into the slide 42 and the back of the stud 60 being movably mounted in a cut-out 62 in the heel clamp 24. Therefore, the position of the heel clamp 24 with respect to the slide 42 may be adjusted about the axis of the pin 58 by rotating the stud 60 by a knob 64 affixed to the stud 60.

In the idle condition of the machine: the insole rest 14 and the adhesive extruder 16 are in lower positions with their tops below the level of the tops of the wipers 12; the wipers 12 and the yoke 18 are in rearward retracted positions; the jaws of the pincers 20 are open; the toe hold-down 22 is in its upper position; and the heel clamp 24 is in a forward position.

Figure 6:
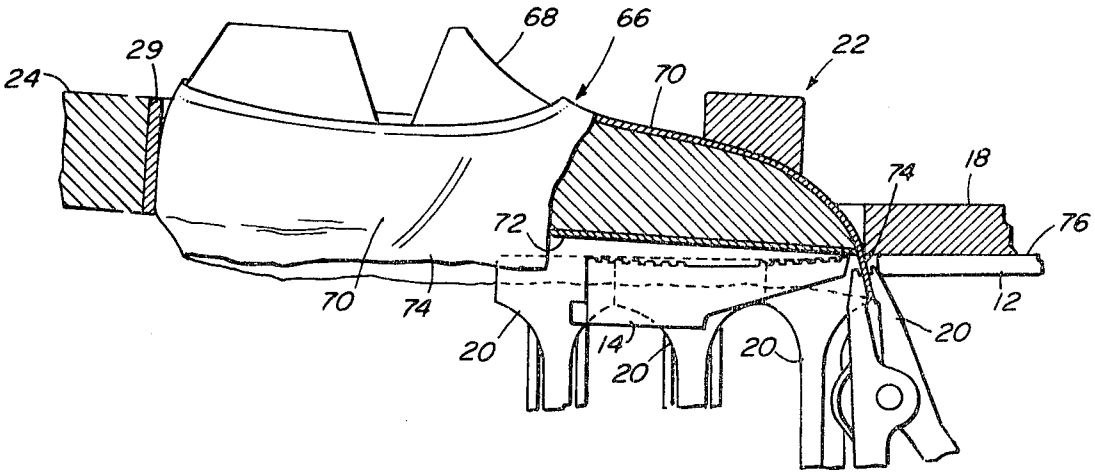
FIG. 6 is a schematic representation of a shoe assembly as it appears in the machine immediately prior to the commencement of the wiping stroke.

Referring to FIG. 6, a shoe assembly 66, formed of a last 68 having an upper 70 draped thereon and an insole 72 secured to its bottom, is presented to the machine 10. The forepart of the shoe assembly bottom is supported on the insole rest 14 with the toe end of the shoe assembly facing rearwardly towards the wipers 12. The shoe assembly is so placed on the insole rest 14 that the bottom of the toe portion of the insole 72 is inclined upwardly and forwardly or heelwardly relative to the insole rest 14 and while in this position the upper margin 74 is placed between the open jaws of all of the pincers 20. The upward and heelward inclination of the bottom of the forepart of the insole 72 facilitates the placement of the upper margin 74 between the open jaws of the rearmost pincers 20 that receives the toe end extremity of the upper margin.

Using, for example, the mechanism shown in U.S. Pat. Re. 29,069, this is followed by the closure of the jaws of the pincers 20 to enable them to grip the upper margin and a raising of the insole rest 14 to thereby raise the shoe assembly 66 while the upper margin 74 is gripped by the pincers 20 to cause the upper 70 to be stretched tightly about the vamp of the last 68. The forepart of the bottom of the insole 72 tends to remain upwardly and heelwardly inclined relative to the insole rest 14 due to the force exerted on the toe end extremity of the shoe assembly by the gripping action of the rearmost pincers 20.

After this, using for example the mechanism of U.S. Pat. Re. 26,860, the heel clamp 24 is moved forwardly to cause the heel pad 29 to engage the heel end of the upper 70 of the shoe assembly 66, as shown in FIG. 6. Prior to the presentation of the shoe assembly 66 to the machine 10, the knob 32 had been manipulated to bring the heel pad 29 to a height corresponding to the height of the heel portion of the upper 70, this height being dependent on the heel height of the shoe assembly 66. Also, prior to the presentation of the shoe assembly 66 to the machine 10, the knob 41 was so manipulated to swing the arm 34 about the pin 36 as to bring the heel pad 29 to a plane that is parallel to the tangent of the curved heel portion of the last 68 and the upper 70 and the knob 64 was so manipulated to so swing the heel clamp 24 about the pin 58 as to cause the heel pad 29 to move heightwise, pursuant to heightwise movement of the slide 42 in a plane parallel to the tangent of the curved heel portion of the last 68 and of the upper 70.

The wipers 12 and the yoke 18 are now caused to move forwardly, for example by mechanism such as that shown in U.S. Pat. No. 3,397,417, to bring them to the FIG. 6 position wherein the wipers 12 are adjacent the shoe assembly 66 in readiness for wiping and the yoke 18 is clamping the toe portion of the upper 70 against the last 68. This is followed, for example in the manner shown in U.S. Pat. No. Re. 26,860, by a lowering of the toe hold-down 22 against the top of the vamp of the shoe assembly 66, under relatively low pressure, to clamp the shoe assembly between the insole rest 14 and the toe hold-down 22. This is also followed, in the manner shown for example in U.S. Pat. No. 4,227,483, by a raising of the adhesive applicator 16 against the toe portion of the insole 72, the extrusion of adhesive against the toe portion of the insole 72 and the lowering of the adhesive applicator 16 away from the insole 72. Also, at about this time, the jaws of the pincers 20 are caused to release the upper margin 74 by, for example, mechanism shown in U.S. Pat. No. Re. 29,069.

Now, in the manner shown for example in U.S. Pat. No. Re. 26,860, the wipers 12 are caused to move forwardly and inwardly in a wiping stroke to engage the toe portion of the upper margin 74 and wipe or fold the toe portion of the upper margin inwardly against the insole 72 to thereby bond the toe portion of the upper margin to the insole by way of the adhesive that had been extruded against the insole. During the wiping stroke, the pincers 20 and the insole rest 14 are lowered out of the path of the oncoming wipers and the toe hold-down 22 is forced downwardly under relatively high bedding pressure to apply increased pressure of the bottom of the shoe assembly 66 against the flat tops of the wipers 12. With the lowering of the insole rest and the application of the bedding pressure, the toe portion of the bottom of the shoe assembly 66 is supported solely by the wipers 12.

Either when the toe hold-down 22 is first brought to bear against the top of the vamp of the shoe assembly 66 under relatively low pressure or when it applies the increased bedding pressure against the top of the vamp of the shoe assembly, the application of the pressure by the toe hole-down 22 causes the bottom of the toe portion of the insole 72 to be pressed flat against the insole rest 14 or the wipers 12 to thereby lower the heel end of the shoe assembly 66 while the heel end of the shoe assembly is being clamped by the heel clamp pad 29. The lowering of the heel end of the shoe assembly 66 enables the slide 42 to lower together with the heel pad 29 against the yieldable upwardly directed force of the spring 50. Due to the aforementioned adjustments of the knobs 41 and 64, the heel clamp pad 29 stays substantially in the plane parallel to the tangent of the heel portion of the last 68 so that it continues to clamp against the heel portion of the shoe assembly 66 during this lowering without scuffing or marring the heel portion of the upper 70, without wrinkling the heel portion of the upper or disturbing the position of the heel portion of the upper on the last 68 and without binding against the heel portion of the shoe assembly 66.

The machine cycle is now completed, the machine parts are returned to their idle positions, and the toe lasted shoe assembly 66 is released from the machine 10.

There follows a recapitulation of those portions of the description of the machine and its mode of operation that are germane to this invention.

The toe lasting machine 10 is operable on the shoe assembly 66 formed of the last 68 having the upper 70 draped thereon and the insole 72 secured to its bottom to wipe the toe portion of the margin 74 of the upper against the corresponding portion of the insole. The machine comprises: wiping means formed of the wipers 12 that are mounted for forward and inward movement in a wiping stroke from a retracted position in a wiping plane formed by the top surfaces 76 (FIG. 6) of the wipers to wipe the top portion of the upper margin against the insole; the insole rest 14, located forwardly of the wiping means 12 in its retracted position, mounted for heightwise movement, so supporting the shoe assembly with the toe portion of the shoe assembly facing rearwardly that the toe portion of the insole bottom is inclined upwardly in a heelward and forward direction relative to the wiping plane after the toe portion of the upper has been stretched about the vamp of the last pursuant to relative upward movement of the insole rest with respect to the pincers 20 gripping the toe portion of the upper margin; the heel clamp pad 29, mounted for movement in forward-rearward directions, located forwardly of the insole rest and engageable, pursuant to its rearward movement, with the heel end of the shoe assembly; the slide 42 mounted for heightwise movement; the spring means, formed by the spring 50, yieldably urging the slide upwardly; connecting means, comprised of the pin 58, connecting the heel clamp pad to the slide for heightwise movement therewith; means, shown for example in U.S. Pat. No. Re. 26,860, for lowering the insole rest out of the path of movement of the wiping means during the wiping stroke to prevent engagement of the insole rest by the wiping means during the wiping stroke; and the toe hold-down 22, located above the insole rest, mounted for downward movement against the vamp of the shoe assembly to press against the vamp of the shoe assembly to clamp the shoe assembly between the toe hold-down and the insole rest prior to the lowering of the insole rest and to thereafter clamp the shoe assembly between the toe hold-down and the wiping means, the pressing of the toe hold-down against the vamp of the shoe assembly causing the heel end of the shoe assembly to rock downwardly until the insole is fully supported by the insole rest or the wiping means.

The machine described in the preceding paragraph is improved, in accordance with this invention, by providing means, comprised of the members 36, 38, and 40, mounting the slide 42, together with the heel clamp pad 29, for forward-rearward swinging adjustment about the prone axis of the pin 36 that is transverse to said forward-rearward directions.

The machine further comprises: the block 30 and the arm 34 pivoted to the block by the pin 36. The slide 42 is mounted for heightwise movement in the arm 34. The machine further comprises: the bolt 40 adjustably mounted to the block and bearing against the arm; and spring means, in the form of the springs 38, yieldably urging the arm 34 forwardly about the axis of the pin 36 against the bolt.

The connecting means connecting the heel clamp pad 29 to the slide 42 comprises: the pin 58, whose axis is parallel to the axis of the pin 36, pivotally mounting the heel clamp pad to the slide; and an adjusting device, formed of the members 60, 62, and 64, for adjusting the angular position of the heel clamp pad with respect to the slide about the axis of the pin 58.

I claim:

1. A toe lasting machine operable on a shoe assembly formed of a last having an upper draped thereon and an insole secured to its bottom to wipe the toe portion of the margin of the upper against the corresponding portion of the insole comprising: wiping means mounted for forward and inward movement in a wiping stroke from a retracted position in a wiping plane to wipe the toe portion of the upper margin against the insole; an insole rest, located forwardly of the wiping means in its retracted position, mounted for heightwise movement, so supporting the shoe assembly with the toe portion of the shoe assembly facing rearwardly that the toe portion of the insole bottom is inclined upwardly in a heelward and forward direction relative to the wiping plane after the toe portion of the upper has been stretched about the vamp of the last pursuant to relative upward movement of the insole rest with respect to pincers gripping the toe portion of the upper margin; a heel clamp pad, mounted for movement in forward-rearward directions, located forwardly of the insole rest and engageable, pursuant to its rearward movement, with the heel end of the shoe assembly; a slide mounted for heightwise movement; spring means yieldably urging the slide upwardly; connecting means connecting the heel clamp pad to the slide for heightwise movement therewith; mans for lowering the insole rest out of the path of movement of the wiping means during the wiping stroke to prevent engagement of the insole rest by the wiping means during the wiping stroke; and a toe hold-down, located above the insole rest, mounted for downward movement against the vamp of the shoe assembly to press against the vamp of the shoe assembly to clamp the shoe assembly between the toe hold-down and the insole rest prior to the lowering of the insole rest and to thereafter clamp the shoe assembly between the toe hold-down and the wiping means, the pressing of the toe hold-down against the vamp of the shoe assembly causing the heel end of the shoe assembly to rock downwardly until the insole is fully supported by the insole rest or the wiping means; characterized in that the machine comprises: means mounting the slide, together with the heel clamp pad, for forward-rearward swinging adjustment about a prone axis that is transverse to said forward-rearward directions.

2. The machine according to claim 1 further comprising: a block; and an arm located rearwardly of the block pivoted to the block by a pin whose axis constitutes the aforementioned axis; wherein said slide is mounted for heightwise movement in the arm; and further comprising: a bolt adjustably mounted to the block and bearing against the arm; and spring means yieldably urging the arm forwardly about said axis against the bolt.

3. The machine according to claim 1 or claim 2 wherein the connecting means connecting the heel clamp pad to the slide comprises: a second pin, whose axis is parallel to the aforementioned axis, pivotally mounting the heel clamp pad to the slide; and an adjusting device interposed between the heel clamp pad and the slide for adjusting the angular position of the heel clamp pad with respect to the slide about the axis of the second pin.

4. A machine according to claim 1 wherein said means mounting the slide, together with the heel clamp pad, is operable to adjust the heel clamp pad substantially in a plane parallel to the tangent of the heel portion of the last.

* * * * *